US006938518B1

(12) United States Patent
Braunberger

(10) Patent No.: US 6,938,518 B1
(45) Date of Patent: Sep. 6, 2005

(54) TWO-STROKE MACHINE FOR MAKING BUTTONS HAVING COPLANAR SHELL FLANGES

(75) Inventor: Benjamin A. Braunberger, Fond du Lac, WI (US)

(73) Assignee: Tecre Co., Inc., Fond du Lac, WI (US)

( * ) Notice: Subject to any disclaimer, the term of this patent is extended or adjusted under 35 U.S.C. 154(b) by 190 days.

(21) Appl. No.: 10/342,064

(22) Filed: Jan. 14, 2003

(51) Int. Cl.[7] ..... A44B 1/06
(52) U.S. Cl. ..... 79/1; 79/1
(58) Field of Search ..... 79/1

(56) References Cited

U.S. PATENT DOCUMENTS 4,867,013 A 9/1989 Braunberger
6,038,944 A * 3/2000 Braunberger ..... 79/4

OTHER PUBLICATIONS 3 sheets from web site of Badge Parts Company printed Jan. 17, 2000.

Tecre Owner's Manual printed 1988, revised 1992 pp. 42-48.

* cited by examiner

*Primary Examiner*—Derris H. Banks
*Assistant Examiner*—Jason Y Pahng
(74) *Attorney, Agent, or Firm*—Ryan Kromholz & Manion, S.C.

(57) ABSTRACT

A machine manufactures buttons having coplanar shell flanges in a two-stroke operation. The machine comprises a crimp die having different resistances to advancement of a ram. The first resistance enables a metal shell margin to partially bend under a flat back that is placed on a first surface of the crimp die. The second resistance enables the shell wall to completely bend against a second surface of the crimp die so as to form flanges that lie in a single plane. Both round and rectangular buttons are manufacturable using the same basic machine. The rectangular machine uses a shifter cage on the ram that rotates in response to indexing a die table on which the crimp die and a pickup die are attached. The round machine uses a rotatable frame on the ram. With the rectangular machine, the shell is initially bent during a pickup stroke of the ram.

34 Claims, 12 Drawing Sheets

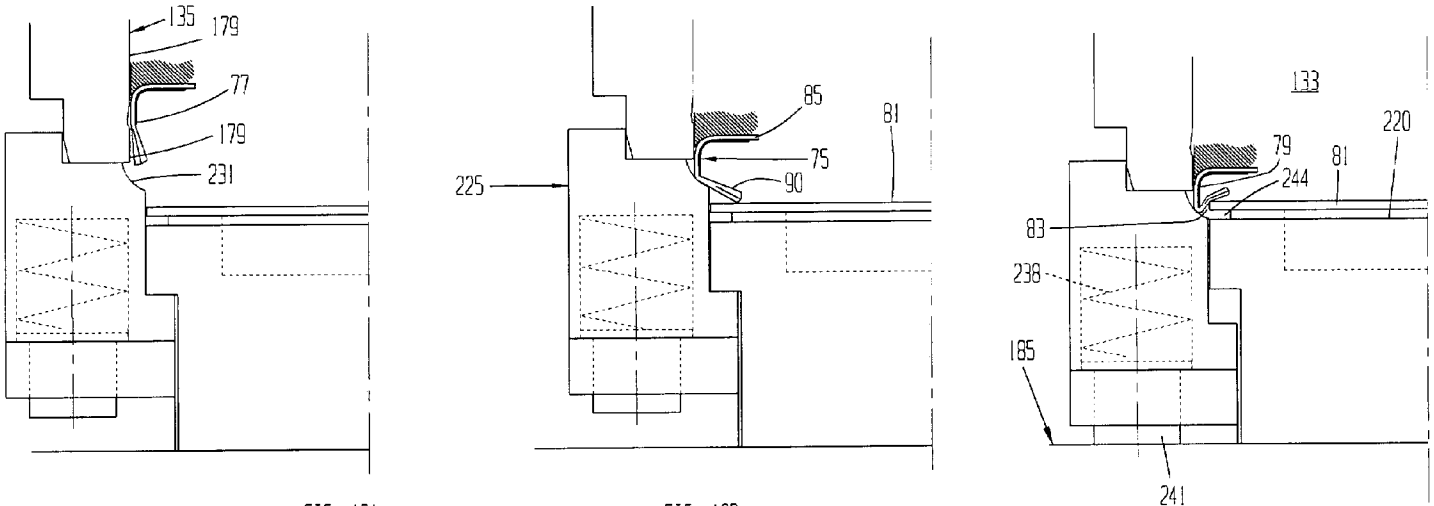
FIG. 18A
FIG. 18B
FIG. 18C
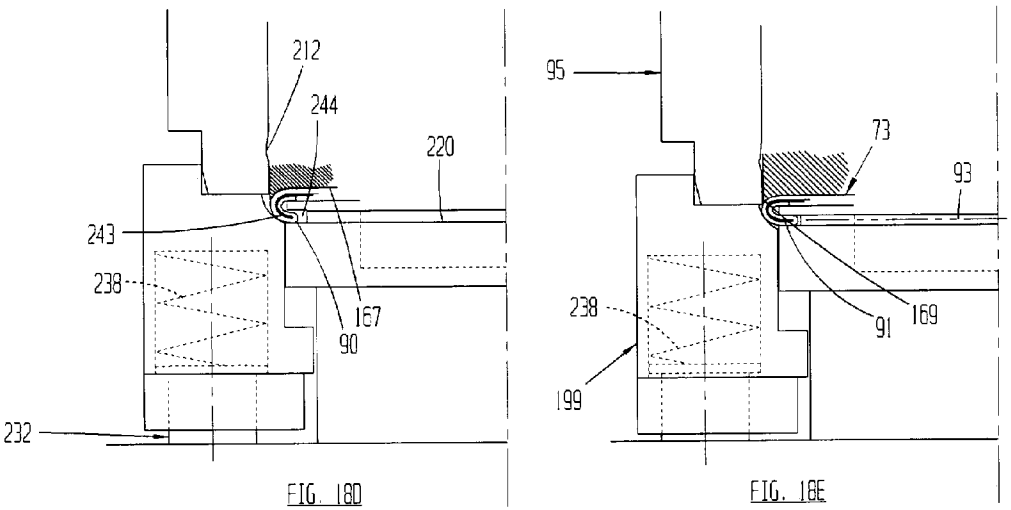
FIG. 18D
FIG. 18E

TWO-STROKE MACHINE FOR MAKING BUTTONS HAVING COPLANAR SHELL FLANGES

BACKGROUND OF THE INVENTION

1. Field of the Invention

This invention pertains to two-piece buttons having coplanar shell flanges, and also to apparatus for manufacturing such buttons.

2. Description of the Prior Art

The word "button" traditionally has included three different types of items: upholstery buttons, apparel buttons, and novelty buttons. The present invention is directed only to novelty buttons, and the word "buttons" as used herein means novelty buttons.

Buttons and machines for manufacturing them are well known and have been in widespread use for many years. Buttons are commercially available in numerous sizes and in several shapes such as round, rectangular, and oval. Buttons may be of one-piece or two-piece construction. In a one-piece button, a flexible graphic is overlaid on a shell. The edge of the graphic is captured between the main portion of a shell wall and a margin of the shell wall that is bent outward and upward to hold the edge or the graphic. A wide variety of one-piece buttons are marketed under the trademark LarLuLine.

Two-piece buttons are generally considered to be of superior quality to one-piece buttons. Referring to FIGS. 1–3, a two-piece button 1 is made from a flat back 39. The flat back button 1 also has a shell 3 and a flexible laminate 7. The laminate 7 typically consists of a sheet of a preprinted graphic 9 covered by a protective film 11 of transparent polyester or similar material. The laminate is overlaid on the dome 13 of the shell 3. At an intermediate step in the process of manufacturing the button 1, a skirt 15 of the laminate overhangs the free edge 17 of an annular wall 19 of the shell.

The flat back 39 has a periphery 41. The skirt 15 of the laminate 7 is tucked around the shell wall free edge 17 and around the flat back periphery 41. Then the shell wall 19 is crimped to become frusto-conical in shape as shown at reference numeral 19A and to capture the laminate between the shell 3 and the flat back. My prior machines as disclosed in U.S. Pat. Nos. 6,038,944 and 6,393,686 are capable of efficiently manufacturing the flat back buttons 1.

Turning to FIGS. 4 and 5, a round flat back button 59 is made from a shell 63 with an annular wall 64 that terminates in a free edge 69. The flat back button 59 further has a flat back 65 with a periphery 68, and a flexible laminate 67. The shell annular wall 64 has a margin 61 adjacent the free edge 69. In the flat back button 59, the shell margin 61 is bent over at 180 degrees to create a round ring-like flange 71. A skirt 66 of the flexible laminate 67 is tucked between the flange 71 of the shell wall 64 and the flat back 65, and around the flat back periphery 68. It is thus seen that the button flange 71 lies in a single flat plane 72 parallel to the flat back 65.

The round button 59 with the coplanar flange 71 is sometimes referred to as a button medallion. That term is used, for instance, in my prior U.S. Pat. Nos. 6,038,944 and 6,393,686 to identify the button 59. Those patents also describe in detail a manual machine and methods for manufacturing round buttons 59 with the coplanar flanges 71. Specifically, my two prior patents disclose a manual machine in which a ram cooperates with a pickup die and a crimp die in a three-stroke process to manufacture the buttons 59 with the coplanar flanges 71. That is, it was necessary to press the button 1 a third time to complete the coplanar button 59.

Buttons with flat backs are not limited to being round in shape. Looking at FIG. 6, the components of a prior rectangular flat back button 43 are shown. The rectangular flat back button 43 has a shell 45, flexible laminate 47, and flat back 49. As illustrated, the flat back 49 is flat for its entire area. However, a back may have margins 51 that are very slightly bent out of plane and still be considered to be a flat back. The flat back may be made of metal or plastic material. The assembled rectangular flat back button is shown in FIG. 7. In the completed rectangular flat back button 43, the four margins 51 of the shell 45 have been crimped, as shown at reference numeral 51A, to make an acute angle with the shell center portion 53. The skirt 55 of the laminate 47 is tucked around the four free edges 56 of the shell and between the four crimped shell margins 51A and the periphery 57 of the flat back 49.

Because of the angular margins 51A, the prior rectangular buttons 43 did not have a finished appearance. In addition, normal processing tolerances sometimes allowed the angular shell margins 51A to inadequately secure the back and graphic to the shell. As a result, the buttons had a tendency to come apart during handling and usage. The angular margins were also prone to snag on clothing and other objects. Some prior rectangular buttons had margins that were more closely parallel to the flat back 49 than is shown in FIG. 7. Nevertheless, while the round buttons 1 with the flat back 39 and frusto-conical shell wall 19A have been accepted by consumers, the prior rectangular buttons 43 with the angular shell walls 51A have not.

To achieve a secure assembly of rectangular buttons with straight line elements instead of angled margins, it is necessary to fully form the flanges into a coplanar configuration. When a round button 1 or rectangular button 43 is further processed to form buttons with flanges that are coplanar and parallel with the flat backs 39 and 49, respectively, a secure assembly is created that engages its ultimate use more desirably. That is, it is more readily adhered to a surface such as a plaque by adhesive or attached to a refrigerator or file cabinet by means of a magnet or simply worn on a garment by means of a safety pin.

A prior rectangular button 73 with coplanar shell flanges is shown in FIGS. 8–10. The button 73 has a shell 75, which is preferably made of sheet metal approximately 0.008 to 0.009 inches thick. The shell 75 has four free edges 77 and clipped corners 78. There is a margin 79 of metal along each of the free edges 77. The button 73 further comprises a rectangular flat back 81 with a periphery 83, and a flexible laminate 85. The laminate 85 is composed of a graphic 87 overlaid with a film 89 of transparent and protective material, such as polyester film. The button 73 is characterized by the fact that the shell margins 79 are bent to have flanges 91 that all lie in a single flat plane 93.

Although my prior manual machines for manufacturing round buttons have met with success, it is desirable to make them even more productive, such as by reducing the number of strokes required to manufacture a button.

Thus, it is desirable to both increase the productivity of button making machines and to increase the variety of readily available buttons.

SUMMARY OF THE INVENTION

In accordance with the present invention, a machine for making round and rectangular buttons having coplanar shell flanges is provided. This is accomplished by apparatus that includes spring cells in a crimp die that enable the machine to operate in a two-stroke process.

The machine of the invention has a framework that includes a base and a pair of columns that support a crown. A ram is guided in and supported by the framework crown for reciprocating along a ram axis. Ram reciprocation is achieved by means of a handle pivotally connected to the framework crown and acting against rollers on the ram. The ram includes a carrier and a plug. The plug has a concave working face opposite the carrier. A ram frame is slidable on the plug parallel to the ram axis. Either the ram frame or the carrier has one or more ram pins that extend parallel to the ram axis. The other of the ram frame or carrier has clearance holes that correspond to the ram pins. One or more springs bias the ram upwardly against the frame crown.

A die table is rotatably indexable on the framework base between two positions. When the die table is in the first position, a pickup die is under the ram. When the die table is in the second position, a crimp die on the die table is under the ram. Indexing the die table also shifts the ram between a pickup mode and a crimp mode of operation. To shift the ram between the pickup and crimp modes, the machine comprises an actuator that acts on the ram in response to indexing the die table. The actuator comprises a shifter post upstanding from the die table and a pair of fingers on the ram. When the die table is indexed, the shifter post travels in an arc to contact one or the other of the fingers. Specifically, when the die table is indexed to position the pickup die under the ram, the shifter post contacts the first finger to shift the ram to the pickup mode. When the die table is indexed to position the crimp die under the ram, the shifter post contacts the second finger to shift the ram to the crimp mode. When the ram is in the pickup mode, the ram pins are misaligned with the corresponding clearance holes. When the ram is in the crimp mode, the ram pins and clearance holes are aligned.

The pickup die has a pickup die pedestal attached to the die table. An outer frame is slidable over the pickup die pedestal. The outer frame has a top surface with a recess in it. One or more pickup die resilient members bias the outer frame away from the die table and against a shoulder on the pickup die pedestal.

The crimp die has a crimp die pedestal attached to the die table. A crimp die outer frame has an inner surface that is slidable over the crimp die pedestal. The outer frame has a bevel between a recess and the inner surface. One or more first crimp die resilient members bias the crimp die outer frame away from the die table and into abutment with the crimp die pedestal. There also are one or more second crimp die resilient members between the crimp die outer frame and the die table.

To use the machine of the present invention to manufacture a round button, the ram, crimp, and pickup dies are round, and the actuator fingers are on the ram frame. The handle is pivoted to a ready position. In that position, the ram springs bias the ram against the frame crown. A round button shell is placed on the pickup die pedestal. A laminate that is to be assembled to the shell is placed in the recess of the pickup die outer frame above the shell. The pickup die outer frame centers the laminate and shell. The die table is indexed to position the pickup die under the ram and rotate the ram frame such that the ram pins misalign with the clearance holes, thereby shifting the ram to the pickup mode. The handle is pivoted in a pickup stroke and advances the carrier, plug, and ram frame together until the frame contacts the laminate on the pickup die outer frame.

Further pivoting of the handle is resisted by the pickup die resilient members. However, further pivoting of the handle causes the misaligned ram pins to push the ram frame and overcome the resistance of the pickup die resilient members such that the pickup die outer frame slides along the pickup die pedestal and bends the laminate over the shell wall.

At the end of the pickup stroke, the laminate is fully bent over the shell and is transferred to and is held, along with the shell, in the ram frame. There is a skirt of the laminate that overhangs the free edge of the shell. Reverse pivoting of the handle to its ready position causes the ram to retract, with the shell and laminate held in the ram frame.

A flat back is placed on the crimp die pedestal. The die table is indexed to position the crimp die under the ram. Indexing the die table causes the actuator shifter post to contact the other finger and rotate the ram frame to align the ram pins with the clearance holes, thereby shifting the ram to the crimp mode.

The handle is pivoted in a crimp stroke until the ram frame contacts the crimp die outer frame. Because of the upward bias of the crimp die resilient members, the ram frame and the crimp die outer frame remain stationary under further pivoting of the handle. That pivoting of the handle does advance the carrier and plug, however, because the ram pins enter the corresponding clearance holes, and the plug slides inside the frame. That action pushes the shell and laminate part way out of the ram frame and causes the laminate skirt to contact the bevel in the crimp die outer frame. The skirt bends inwardly over and unto the top of the flat back. That action continues until the laminate next to the shell wall free edge contacts the bevel in the pickup die outer frame.

Further pivoting of the handles causes the carrier to contact the ram frame. Because of the resistance of the shell wall to bending, further advancement of the ram slides the crimp die outer frame against the first crimp die resilient members. That action causes the shell and laminate to more closely approach the flat back on the crimp die pedestal and further bend the laminate skirt over the flat back. Ultimately, the crimp die first and second resilient members combine to produce a force that resists further movement of the crimp die outer frame. Continued handle pivoting then forces a margin of the shell wall to bend inwardly against the bevel on the crimp die outer frame and under the flat back, thereby capturing the laminate skirt between the shell wall bent-over margin and the flat back periphery. At that point, the bent shell margin is between the flat back and a relief surface of the crimp die pedestal and makes an acute angle with the flat back. An additional small amount of handle pivoting overcomes the combined force of the first and second crimp die resilient members and forces the crimp die outer frame downwardly a small distance enough to allow the ram plug to bend the shell margins against the crimp die pedestal into flanges that are flat and coplanar all around the shell and complete the button assembly. The handle is reversed to its ready position, thereby exposing the completed button for removal.

It is an important feature of the invention that both round and rectangular buttons with coplanar shell flanges are manufacturable on the same basic machine. To make the rectangular button of the invention, the ram plug and frame are rectangular in shape, as are the pickup die and crimp die. The actuator for the rectangular machine is composed of the shifter post on the die table. The carrier on the rectangular machine is in two parts: a guide bar, and a shifter cage that is rotatable on the guide bar. The ram pins and clearance holes may be in either the shifter cage or the outer ring.

Indexing the die table to position the pickup die under the ram causes the actuator to shift the ram to the pickup mode of operation by contacting the shifter post with one of two fingers on the shifter cage and rotating the cage on the guide bar to misalign the clearance holes with the ram pins. Indexing the die table to position the crimp die under the ram causes the shifter post to contact the other shifter cage finger and rotate the cage to align the clearance holes with the ram pins. The same two-stroke operation is used whether the machine is used for making round or rectangular buttons.

The method and apparatus of the invention, using first and second resilient members on the crimp die, thus manufactures buttons with coplanar flanges on a production bases. Only two ram strokes are required to manufacture the buttons, even though both round and rectangular buttons are manufactured using the same basic machine and principles of operation.

Other advantages, benefits, and features of the present invention will become apparent to those skilled in the art upon reading the detailed description of the invention.

BRIEF DESCRIPTION OF THE DRAWINGS

FIGS. 18A–18E show the action of the ram die and crimp die during the crimp stroke.

DETAILED DESCRIPTION OF THE INVENTION

Figure 1:
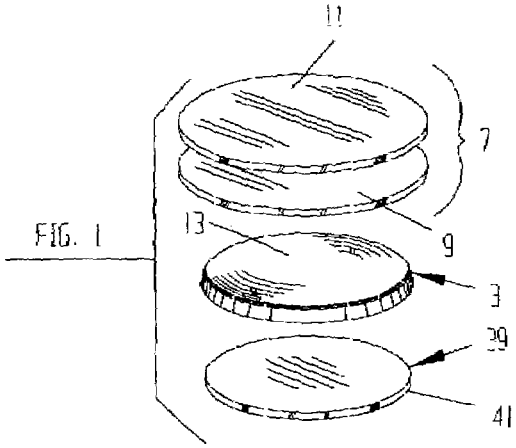
FIG. 1 is an exploded view of a typical prior round button made with a flat back.
Figure 2:
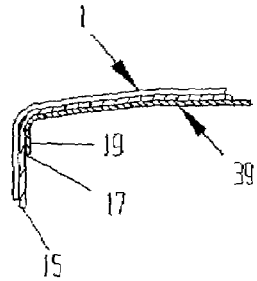
FIG. 2 PRIOR ART
FIG. 2 is a partial cross-sectional view of a partially assembled button made from the components of FIG. 1.
Figure 3:
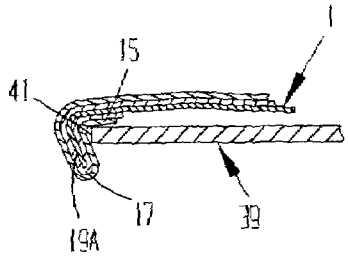
FIG. 3 PRIOR ART
FIG. 3 is a partial cross-sectional view of the assembled flat back button of FIGS. 1 and 2.
Figure 4:
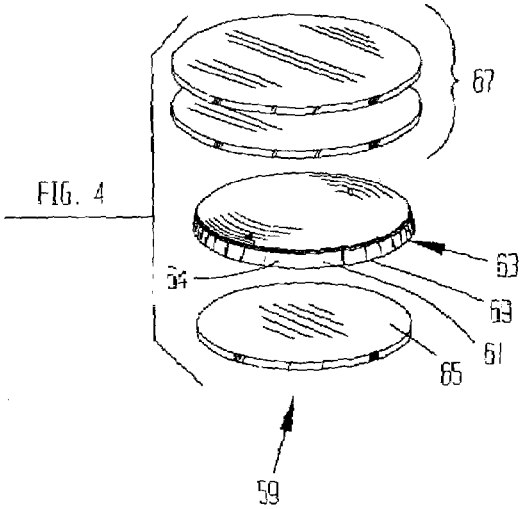
FIG. 4 is an exploded view of the components of a typical prior round button with coplanar shell flanges.

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

General

To manufacture the rectangular button 73 with the coplanar shell flanges 91, the present invention includes a two-stroke manual machine 95, FIGS. 11–19. The machine 95 is comprised of a framework 97 that includes a base 99, a center column 101, an end column 103, and a crown 105. Screws 107 attach the crown 105 to the columns 101 and 103. Screws 109 attach the columns to the base 99.

Figures 11, 13:
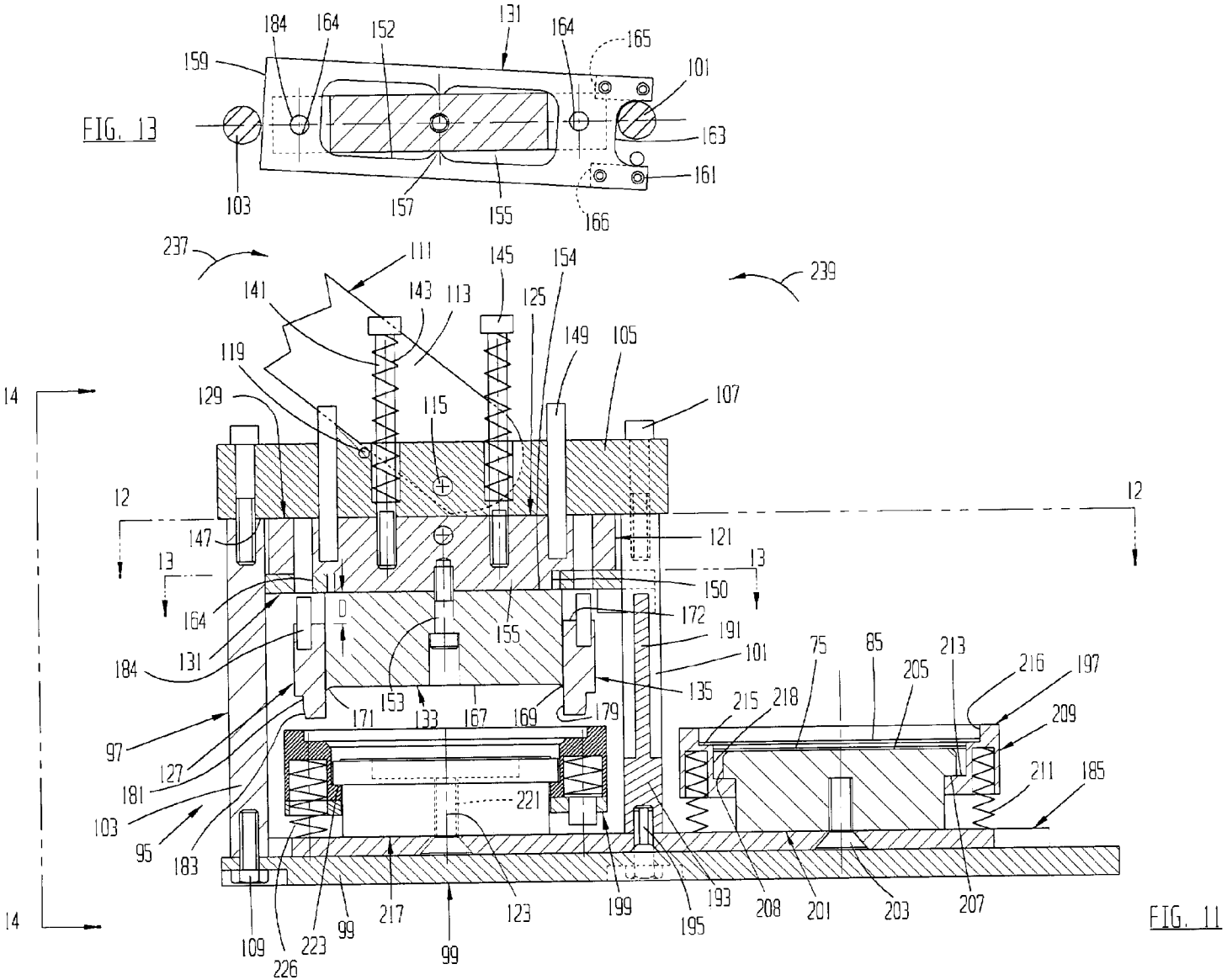
FIG. 11 is a cross-sectional view taken along line 11—11 of FIG. 12 showing the machine of the invention with the crimp die under the ram.
FIG. 13 is a view taken along line 13—13 of FIG. 11.

Pivotally connected to the crown 105 is a handle 111. In the illustrated construction, the handle 111 has a pair of plates 113 that straddle the crown and that are pivotally connected to it by a pin 115. The plates 113 terminate in a hand grip 117. The plates have respective cam surfaces 118 opposite the grip 117. As shown in FIG. 11, the handle is in a ready position whereat the plates rest against rest pins 119 pressed into the crown.

Ram

A ram 121 is supported and guided by the crown 105 for reciprocating along a vertical ram axis 123. The ram 121 includes a carrier 125 and a ram die 127. For the particular machine 95 illustrated, the carrier 125 is made with a guide bar 129 and a shifter cage 131. The guide bar 129 has a pair of screws 141 threaded into it. The screws 141 pass through corresponding holes in the frame crown 105. Ram springs 143 between the heads 145 of the screws 141 and the crown bias the ram upwardly against the underside 147 of the crown. To guide the ram 121 during reciprocation, a pair of guide pins 149 are pressed into the guide bar 129. The guide pins 149 are slidable through associated holes in the crown.

There are a pair of steps 150 on the opposite ends of the guide bar 129 such that the guide bar has a foot section 155. Projecting oppositely from the ram plate guide bar 129 are a pair of rollers 151. The rollers 151 are so located as to be contactable by the cam surfaces 118 of the handle 111 when the handle is pivoted away from the ready position.

The ram die 127 is composed of a rectangular plug 133, a four-sided ram frame 135, and a pair of support blocks 137. One surface 154 of the ram plug 133 is immovably fastened to the foot section 155 of the guide bar 129 by a screw 153 and alignment elements such as roll pins, not illustrated in the drawings. A working surface 167 of the plug opposite the surface 154 has a rectangular peripheral lip 169 with a concave inner surface 171.

The ram frame 135 is free to slide on the plug 133 through a distance D in the directions of the ram axis 123. Sliding in the upward direction is limited by contact by the frame top surface 172 with the shifter cage 131. Sliding in the downward direction is limited by overhangs 174 of the support blocks 137, which are joined to the upper surface 172 of the ram frame by fasteners 175. The frame has a bottom surface 177, four inner surfaces 179, and an outer surface 181. As best shown in FIGS. 18A–18E, the inner surfaces 179 of the ram frame 135 have respective shallow grooves 212, which preferably have a scallop contour. There preferably is a chamfer 183 at the junction of the bottom and outer surfaces 177 and 181, respectively. At least one, and preferably two, pins 184 are pressed in the frame top surface 172 and are parallel to the ram axis 123. The pins 184 have a protruding length that is slightly less than the sliding distance D of the ram frame on the plug.

The carrier shifter cage 131 is supported on the ram plug surface 154 and is free to rotate on it. For that purpose, the shifter cage has a center opening 152 that fits loosely over the guide bar foot section 155. A pair of center lugs 157 in the shifter cage opening 152 loosely straddle the guide bar foot section. One end 159 of the shifter cage is close to the frame end column 103. The other end 161 of the shifter cage has a cutout 163 that straddles the frame center column 101. The shifter cage has holes 164 through it that are at the same distance from the ram axis 123 as the pins 184 in the ram frame 135.

Pickup Die and Crimp Die

Rotatably supported on the frame base 99 is a die table 185. There is a hole in the die table 185 that fits over the frame center column 101. In the preferred embodiment, the die table is indexible through 180 degrees about the center column. The opposite ends of the die table are formed with first and second cutouts 187 and 189, respectively. The cutouts 187 and 189 are located such that they are contactable with the frame end column 103.

Mounted to the opposite ends of the die table 185 are a pickup die 197 and a crimp die 199. The pickup die 197 comprises a pedestal 201 fastened to the die table by one or more screws 203 and alignment elements not shown. The pickup die pedestal 201 has a flat top surface 205 and four external shoulders 207. Between the top surface 205 and the external shoulders 207 are four side surfaces 208, each having a slight upward draft. An outer frame 209 is slidable over the pedestal. The outer frame 209 is biased away from the die table such that internal shoulders 213 normally contact the pedestal external shoulders 207. For that purpose, one or more resilient members are interposed between the outer frame and the die table. For example, a ring of resilient polyurethane material may surround the outer frame and contact the die table. As shown, several pickup springs 211 are used as the resilient members. The outer frame has a recess 215 in the top surface with an internal surface 216, and another internal surface 218.

The crimp die 199 is composed of a crimp die pedestal 217 having a top surface 219. Multiple fasteners including a screw 221 hold the crimp die pedestal 217 to the die table 185. The crimp die pedestal has an external shoulder 223. A relief surface 220 is parallel to and spaced from the top surface 219. An outer frame 225 is slidable over the crimp die pedestal. One or more first crimp die resilient members bias the outer frame 225 such that an internal shoulder 227 thereof contacts the pedestal external shoulder 223. As illustrated, the first crimp die resilient members are crimp die springs 226. However, other resilient members, such as a ring of resilient polyurethane material, may be used instead of the springs 226. The crimp die outer frame has a top surface 228 with a recess 229. A bevel 231 is between the recess 229 and an inner surface 224. The bevel 231 may be flat, but I prefer a concave scalloped shape as is illustrated. The crimp die further has one or more second resilient members between the die table and the crimp die outer frame. For example, the second resilient member may be a second ring of resilient polyurethane material. According to the aspect of the invention that is illustrated, the second resilient members are a number of spring cells 232. The spring cells 232 are received in associated bores in the bottom of the crimp die outer frame and are held there by a plate 234 and fasteners 236. Each spring cell has a very stiff spring 238 and a plunger 241.

Actuator

The final major component of the machine 95 is an actuator 235. In the machine with the rectangular ram die 127, pickup die 197, and crimp die 199, the actuator 235 is comprised of a pair of fingers 165 and 166 on the shifter cage 131. The fingers 165 and 166 are on opposite sides of the cutout 163. The actuator further has a vertical shifter post 191 joined to the die table 185. As shown, the shifter post 191 includes a pad 193 that is held to the die table by a screw 195. The shifter post 191 is long enough to reach between the fingers 165 and 166 on the shifter cage 131 when the ram 121 is retracted against the framework crown 105.

Operation

Figure 16:
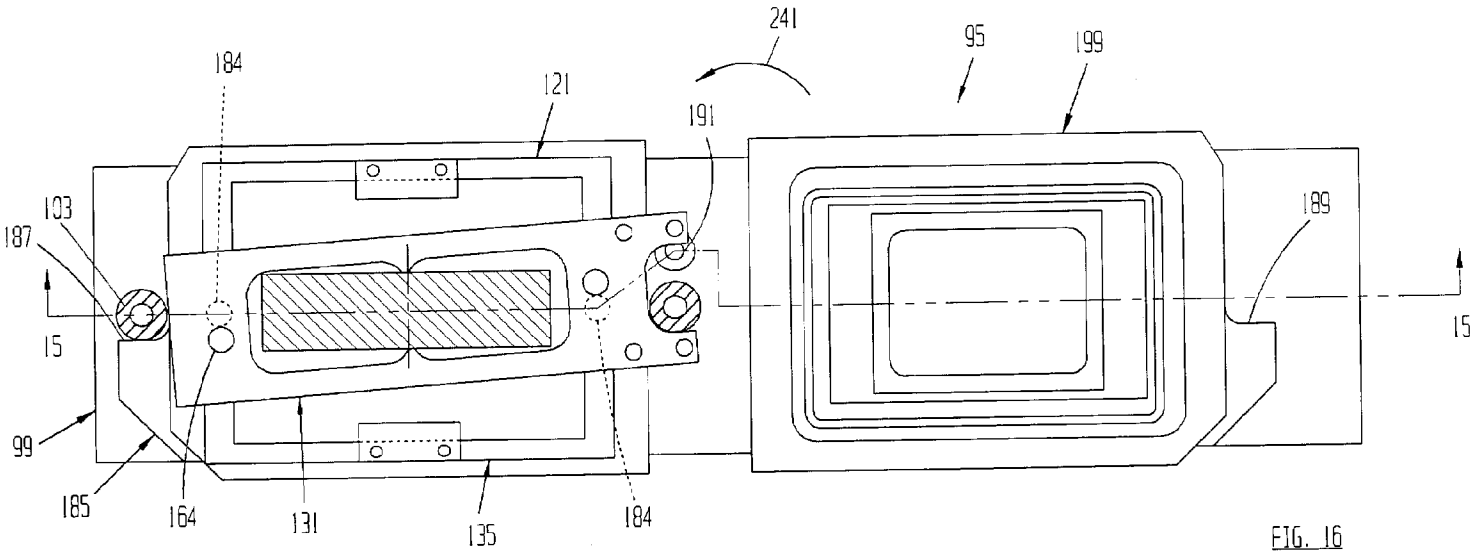
FIG. 16 is a view taken along line 16—16 of FIG. 15.
Figure 12:
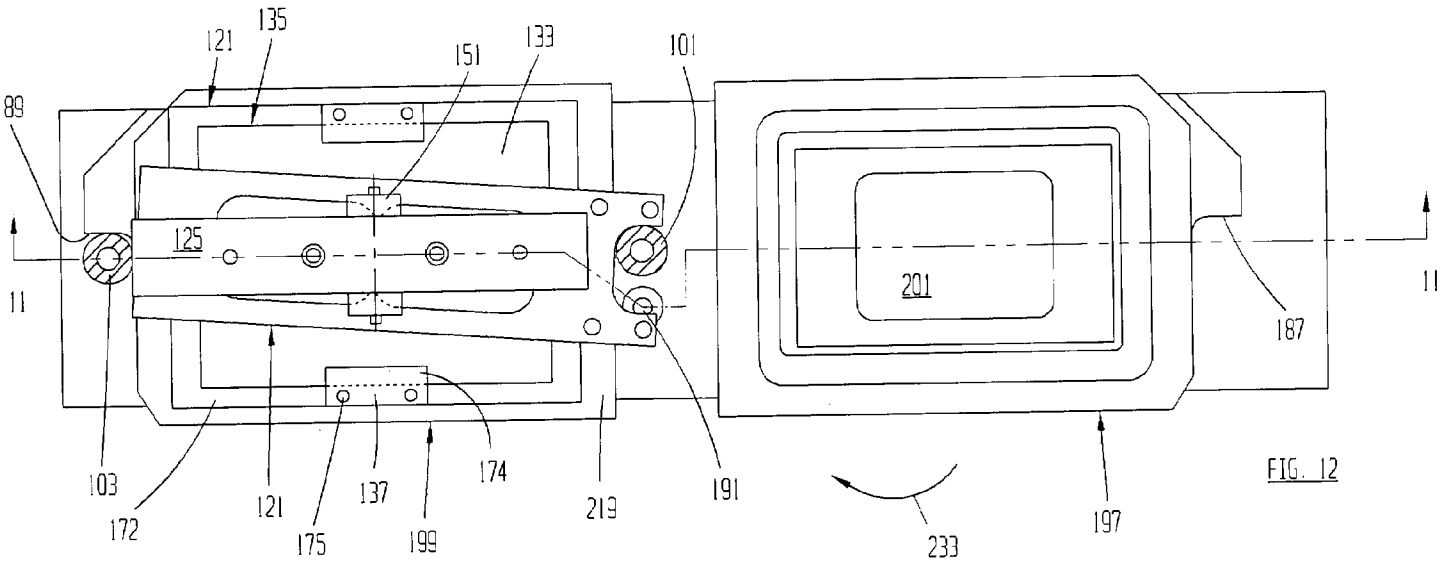
FIG. 12 is a view taken along line 12—12 of FIG. 11.
Figure 14:
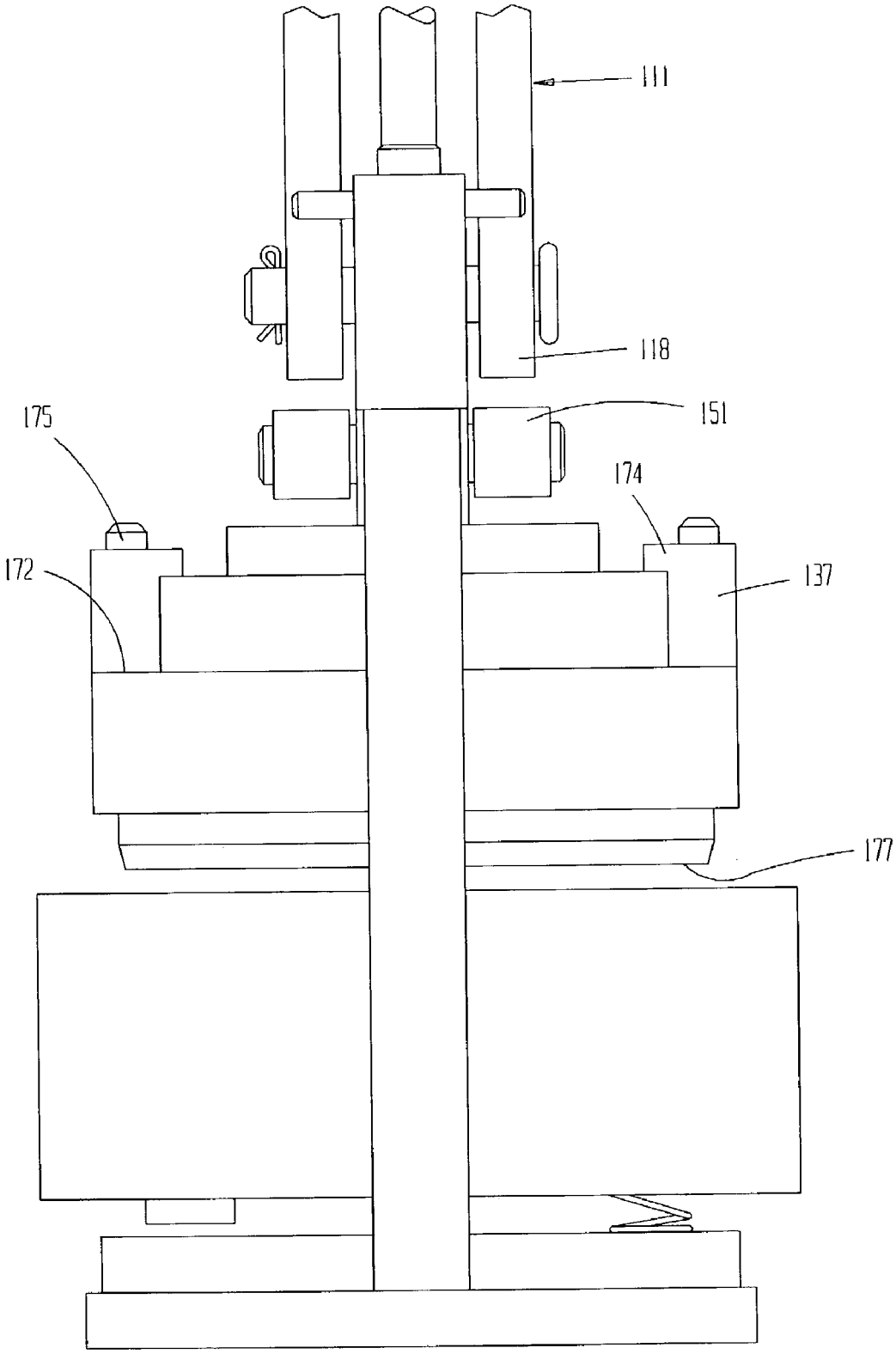
FIG. 14 is a view taken along line 14—14 of FIG. 11.
Figure 15:
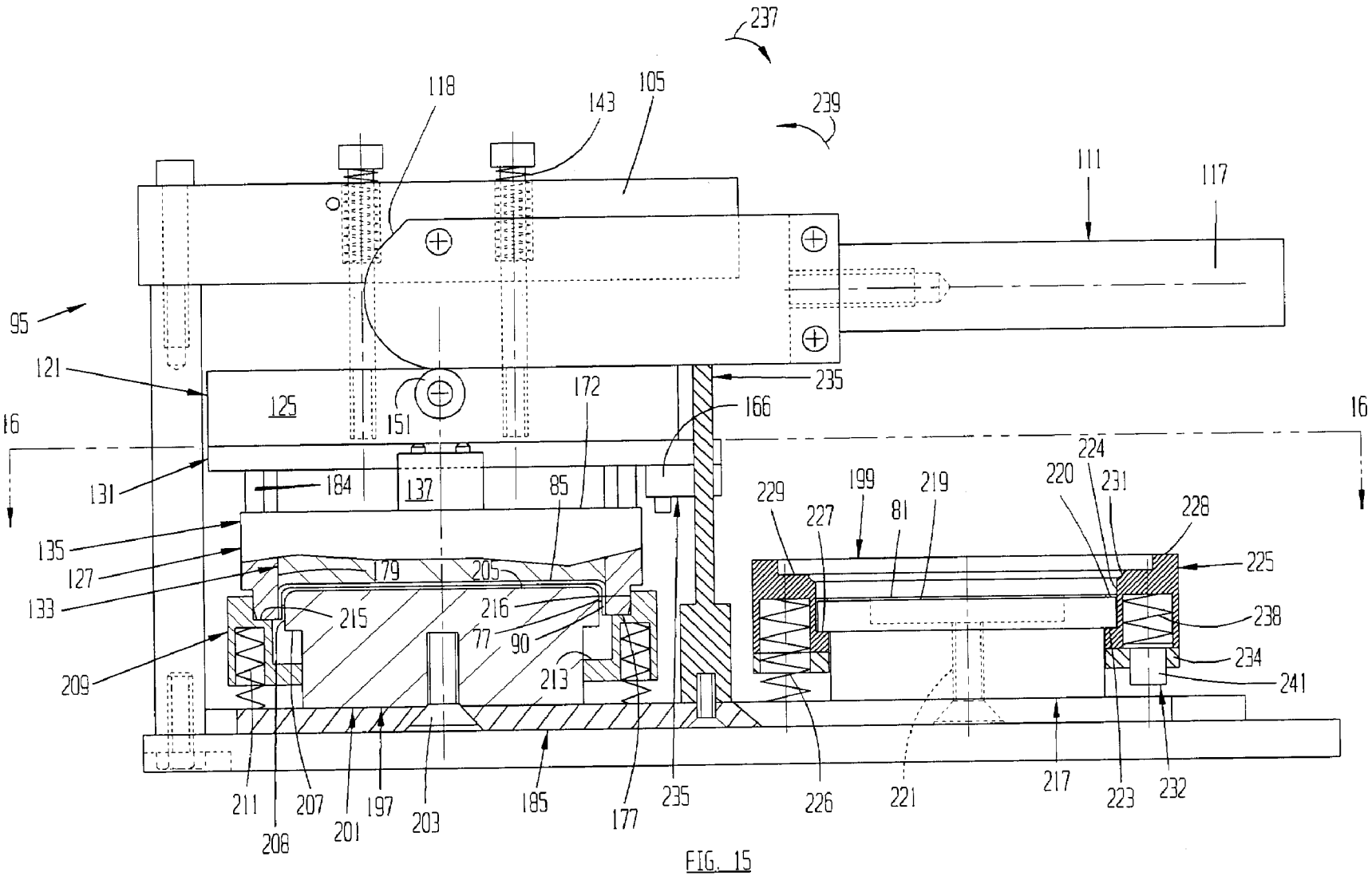
FIG. 15 is a broken cross-sectional view taken along line 15—15 of FIG. 16 showing the pickup die under the ram and the ram advanced in a pickup stroke.

The operation of the machine 95 of the present invention to manufacture a rectangular flat back button 73 begins by placing a shell 75 on the pickup die pedestal 201. See FIG. 11. The shell is held in place laterally by the internal wall 218 of the pickup die outer frame 209. A laminate 85 is placed on the outer frame recess 215. Then the die table 185 is indexed in the direction of arrow 233, FIG. 12, until the die table cutout 187 contacts the frame end column 103. Indexing the die table shifts the ram 121 to the pickup mode. That is achieved by the travel of the actuator shifter post 191 in an arc to contact the finger 165 and rotate the carrier shifter cage 131 as shown in FIG. 16. When the ram is in the pickup mode, the holes 164 in the shifter cage are misaligned with the pins 184 in the ram frame 135. See FIG. 16. It will be appreciated, of course, that the operation of the machine 95 would be identical if the pins 184 were in the shifter cage 131 and the holes 164 were in the frame 135.

The handle 111 is pivoted in the direction of arrow 237 in a pickup stroke. Doing so causes the cams 118 on the handle plates 113 to push against the ram rollers 151 and advance the ram 121. The carrier 125, plug 133, and ram frame 135 advance together until the frame bottom surface 177 contacts the laminate 85 in the pickup die 197. The handle continues to pivot, which causes further advancement of the carrier and the plug, but the springs 211 of the pickup die outer frame 209 resist further advancement of the ram frame. However, the carrier shifter cage 131 bears against the pins 184 in the ram frame, so the force from the handle is transferred through the laminate to the pickup die outer frame. The force applied to the handle is sufficient to compress the pickup die springs and force the pickup die outer frame downwardly toward the die table 185. That action takes up the clearance between the laminate and the shell 75 (FIG. 11). Further ram advancement causes the ram frame bottom surface 177 and inner surface 179 to cooperate and progressively bend the margins 79 of the shell 75 over the pickup die pedestal 201, and simultaneously bend the laminate 85 over the shell, FIG. 15. The laminate then has a skirt 90 that overhangs the free edges 77 of the shell.

At the end of the pickup stroke, the grooves 212 in the ram frame inner surfaces 179 are located opposite the shell bent margins 79. The inherent elasticity of the shell material causes the bent margins and adjacent portions of laminate 85 to enter and press against the grooves such that the bent shell and laminate transfer to the ram. The handle 111 is pivoted in the reverse direction 239. The ram springs 143 urge the ram 121 upwardly against the framework crown 105. As the ram retracts, the bent laminate 85 and shell 75 remain inside the ram frame inner surfaces 179. The draft of the pickup die pedestal side surfaces 208 assist in the transfer of the shell and laminate to the ram.

A flat back 81 is placed on the crimp die pedestal 217. The die table 185 is then indexed in the direction of arrow 241, FIG. 16, until the die table cutout 189 contacts the frame end column 103. The crimp die 199 is then under the ram 121. Also see FIG. 17. Indexing the die table to position the crimp die under the ram shifts the ram to the crimp mode. That is achieved by the arcuate travel of the actuator shifter post 191 to contact the finger 166 on the shifter cage 131 and rotate the shifter cage to the position shown in FIGS. 12 and 13. In that situation, the holes 164 in the shifter cage are aligned with the pins 184 in the ram frame 135.

Figure 17:
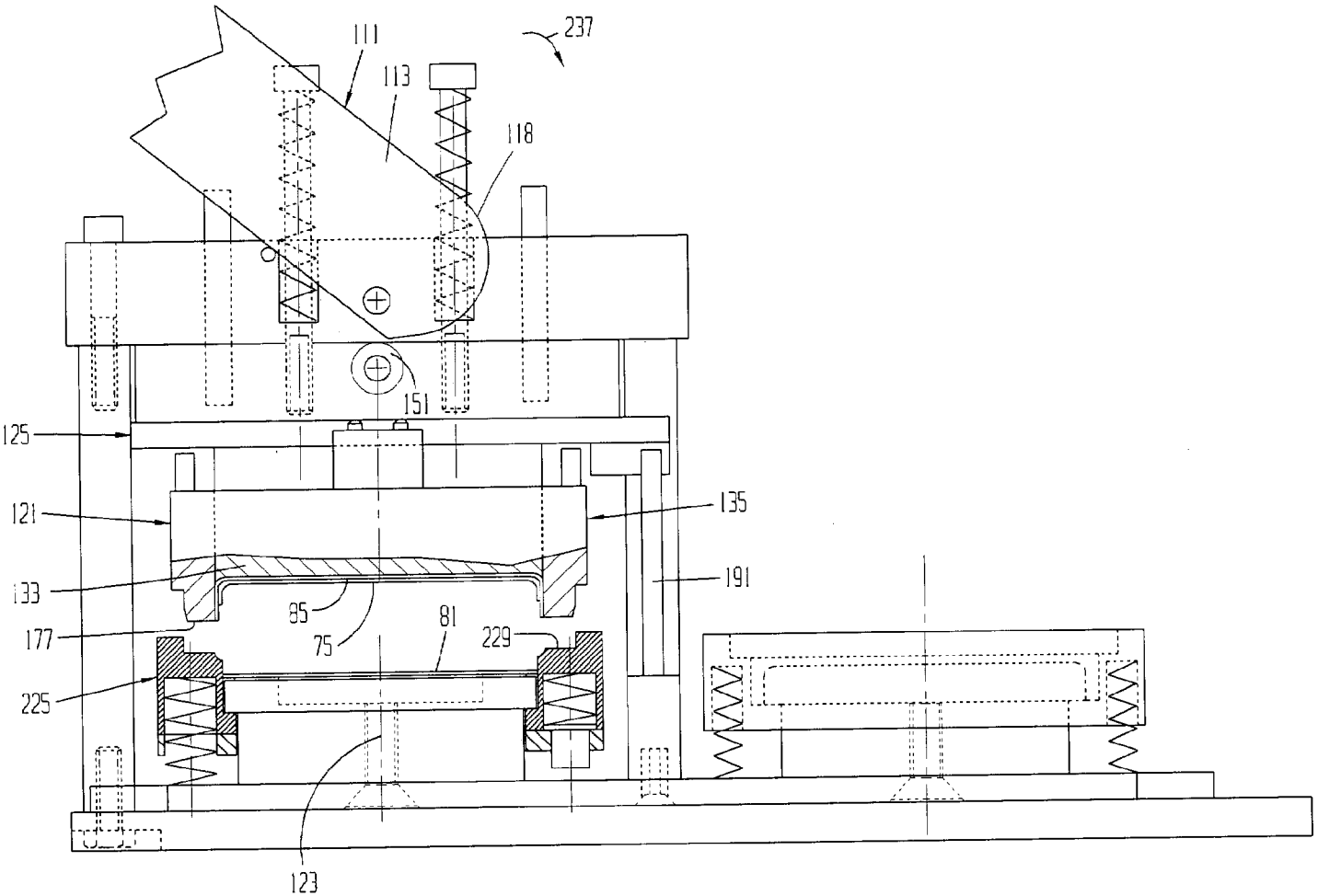
FIG. 17 is a partial cross-sectional view generally similar to FIG. 11 but showing the machine at the start of the crimp stroke.

The crimp stroke begins as shown in FIG. 17. The handle 111 is pivoted in the direction of arrow 237 to advance the ram 121, together with the laminate 85 and shell 75, along the ram axis 123. Ram advancement continues in a first movement in which the bottom surface 177 of the ram frame 135 contacts the recess 229 in the crimp die outer frame 225. Also see FIG. 18A. Although the handle 111 continues to pivot, the crimp die springs 226 resist any downward motion of the crimp die outer frame 225 and also any further advancement of the ram frame 135. The pins 184 enter the associated clearance holes 164. Consequently, the ram plug 133 slides inside the ram frame, FIG. 18B. That action pushes the shell 75 and laminate 85 most of the way out of the ram frame inner surface 179 and also causes the skirt 90 of the laminate to contact the bevel 231 of the crimp die outer frame and bend inwardly on top of the flat back 81.

Advancement of the ram plug 133 continues in a second movement in which the free edges 77 of the shell 75 approach the bevel 231 and becomes separated from it only by the laminate 85. With the plug 133 pushing on the shell and laminate, resistance to bending of the metal shell forces the crimp die outer frame 225 downwardly against the resistance of the springs 226. As a result, the shell and laminate approach the flat back 81. The laminate skirt 90 tucks between the shell margins 79 and the flat back periphery 83. The crimp die outer frame continues to move until the plungers 241 of the spring cells 232 abut the die table 185, FIG. 18C. At that point, the crimp die outer frame bevel and the crimp die pedestal relief surface 220 form a substantially continuous surface.

Figure 7:
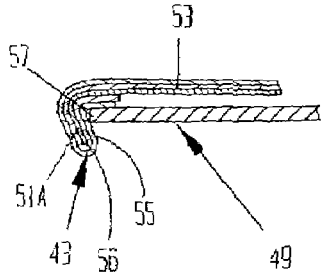
FIG. 7 PRIOR ART
FIG. 7 is an partial cross-sectional view of the assembled rectangular button of FIG. 6.
Figure 8:
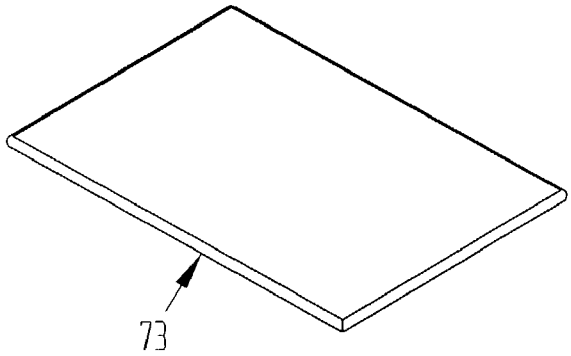
FIG. 8 is a perspective top view of a prior rectangular button with coplanar shell flanges.
Figure 9:
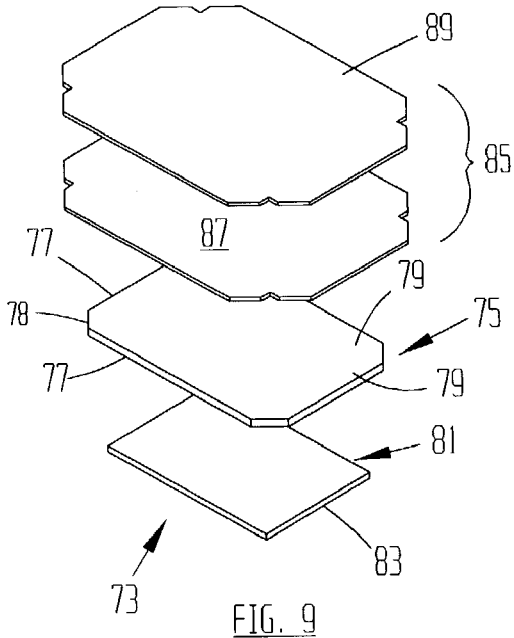
FIG. 9 is an exploded view of the components of the rectangular button of FIGS. 8 and 8A.
Figure 8A:
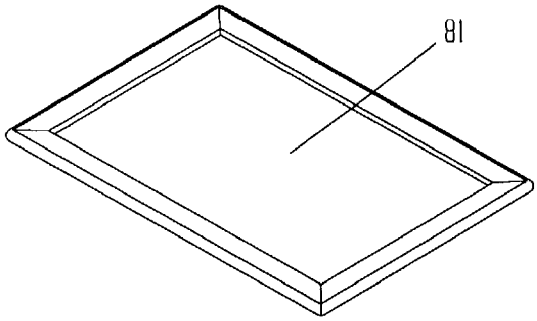
FIG. 8A is a perspective bottom view of the rectangular button with coplanar shell flanges of FIG. 8.
Figure 10:
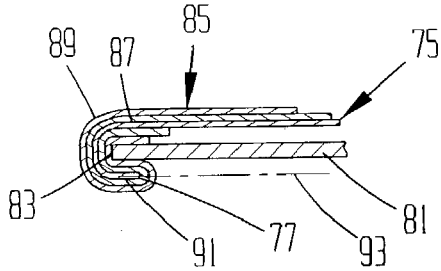
FIG. 10 is a partial cross-sectional view of the rectangular button of FIG. 8.

The stiffness of the spring cell springs 238 combine with the stiffness of the crimp die springs 226 to prevent further movement of the crimp die outer frame 225, so continued pivoting of the handle 111 and advancement of the ram plug 133 is not accompanied by any movement of the crimp die outer frame or the ram frame 135. Consequently, the ram plug 133 slides further inside the ram frame and further pushes the shell 75 and laminate 85 out of the ram frame. The force applied to the handle is sufficient, because of the scalloped bevel 231, to bend the shell margins 79 into angular flanges 243. The continuous surface between the bevel and the pedestal relief surface 220 guides the shell angular flanges 243 and laminate skirt 90 into a notch 244 under the flat back 81 as the ram plug approaches the crimp die pedestal 281, effectively forming the button slightly beyond that illustrated in FIG. 7. See FIG. 18D.

Figure 19:
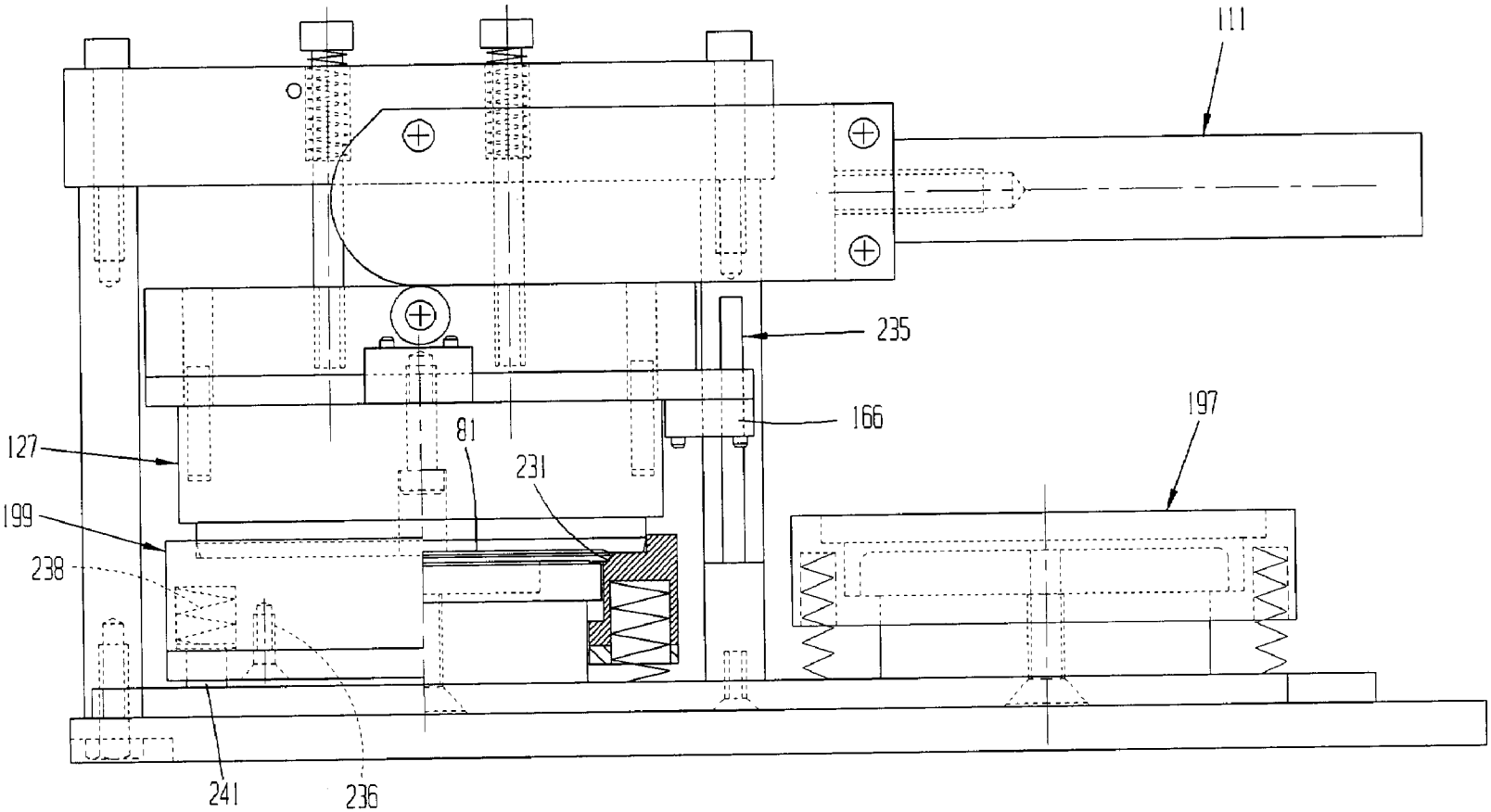
FIG. 19 is a partially broken view generally similar to FIG. 17, but showing the machine at the end of the crimp stroke but without button parts in the machine.

To complete the manufacture of the rectangular button 73, a final force is applied to the machine handle 111, FIG. 19. The final force is transferred to the ram plug 133. The final force advances the ram 121 in a third movement of the crimp stroke in which the ram plug working surface 167 and lip 169 push against the shell 75 and laminate 85 and further bend the shell angular flanges 243 against the crimp die pedestal relief surface 220. As the shell angular flanges are further bent against the crimp die pedestal relief surface, the lines of contact between the laminate and the crimp die outer frame bevel 231 move slightly upwardly along the bevel. That causes the crimp die outer frame to be forced downwardly slightly against the combined forces of the spring cells 232 and the crimp die springs 226. The shell angular flanges thus bend into flanges 91 that are flat and that lie in the single plane 93, FIG. 18E. The handle 111 is then reverse pivoted in the direction of arrow 239, the die table 185 is indexed in direction of arrow 233, and the completed rectangular button 73 is removed from the crimp die 199. In that manner, the rectangular button is completely manufactured using only two strokes of the machine 95.

Round Button Machine

Further in accordance with the present invention, round buttons 59 with coplanar shell flanges 71 are also manufactured in a two-stroke process. Turning to FIGS. 20–25, a machine 247 has a framework 97' comprised of a base 99', center column 101', end column 103', and crown 105' that are substantially similar to the corresponding components of the machine 95 of FIGS. 11–19. The machine 247 further has a handle 111' that pivots in the crown 105' to advance a ram 249 along a ram axis 123'. A die table 185' is indexible about the framework center column 101' to position either a pickup die 251 or a crimp die 253 under the ram 249.

The ram 249 is composed of a carrier 257 with rollers 258 that are contactable by cams 118' on the handle 111'. The carrier 257 is guided for reciprocation along the ram axis 123' by screws 141'. Ram springs 143' cooperate with the screws 141' to bias the carrier against the crown 105'. The carrier has a pair of holes 164' that are parallel to the ram axis 123'.

The ram 249 further comprises a cylindrical plug 259 fastened to the carrier 257. The plug 259 has a working surface 167' with a circular lip 169' having a concave surface 171'. The plug has an external shoulder 261.

Slidable and rotatable over the ram plug 259 is an annular ram frame 263. The ram frame 263 has an inner surface 307. In the inner surface 307 may be annular groove similar to the grooves 212 in the ram frame 135 of the rectangular machine 95 described previously. Sliding of the frame 263 in the downward direction is limited by an internal shoulder 265 that contacts the plug external shoulder 261. Alternately, sliding of the frame on the plug may be limited by one or more support blocks, not shown but joined to the frame 263 with overhangs that contact the plug in the same fashion as the support blocks 237 of the machine 95 described previously. A pair of pins 184' are pressed in the frame top surface 172'. The pins 184' are at the same distance from the ram axis 123' as the holes 164' in the carrier 257. The frame is able to slide on the plug 259 a distance D, which is limited in the upward direction by contact of the frame top surface 172' with the carrier 257.

Actuator

The machine 247 of the invention further comprises an actuator 267. In the particular machine illustrated, the actuator 267 is a shifter post 191' and pad 193' upstanding from the die table 185' and fastened to it by a screw 195'. The actuator also includes a pair of fingers 269 and 271 that jut from the ram frame 263. The fingers 269 and 271 are on opposite sides of the framework center column 101'. Indexing the die table 185' causes the shifter post 191' to travel in an arc about the framework center column 101' and contact one or other of the fingers. Although not illustrated, the pins 184' may be in the carrier 257 instead of in the ram frame 263. In that case, the holes 164' would be in the ram frame.

Pickup Die And Crimp Die

The pickup die 251 of the machine 247 is comprised of a pickup die pedestal 273 fastened to the die table 185'. The pickup die pedestal 273 has a round side surface 274 with a slight upward draft. An outer frame 275 is slidable over the pickup die pedestal 273. Pickup die springs 277 or other resilient members bias the outer frame 275 against an external shoulder 276 on the pickup die pedestal. There is a recess 279 in the pickup die outer frame top surface 278, and an inner surface 280 next to the recess.

A crimp die 253 has a crimp die pedestal 281 with a top surface 284 and an external shoulder 285. A crimp die outer frame 287 is biased by resilient elements such as crimp die springs 289 such that an internal shoulder 291 contacts the crimp die pedestal external shoulder 285. The crimp die outer frame 287 has a recess 293 and a bevel 295 between the recess and an inner diameter 297. The crimp die outer frame further has a number of spring cells 299, each with a stiff spring 301 and a plunger 303.

Operation

The operation of the machine 247 to manufacture round buttons 59 is very similar to the operation of the machine 95 for manufacturing rectangular buttons 73. A shell 63 is placed on the pickup die pedestal 273. The shell is guided laterally by the pickup die outer frame inner surface 280 or by the pedestal side surface 274. A laminate 67 is placed in the recess 279 of the pickup die outer frame 275. The die table 185' is indexed in the direction of arrow 233' to position the pickup die 251 under the ram 249. Indexing the die table 185' causes the shifter post 191' of the actuator 267 to contact the finger 271 and rotate the ram frame 263 on the plug 259. When that occurs, the pins 184' in the frame 263 become misaligned with the clearance holes 164' in the carrier 257, FIG, 24.

The handle 111' is pivoted in the direction of arrow 237' in a pickup stroke. Doing so causes the handle cams 118' to push against the ram rollers 258 and advance the ram 249. The carrier 257, plug 259, and ram frame 263 advance together until the frame bottom surface 304 contacts the laminate 67 in the pickup die 251. The handle continues to pivot, which causes further advancement of the carrier 257 and the plug 259. The springs 277 of the pickup die outer frame 275 resist further advancement of the ram frame 263. However, the carrier bears against the pins 184' in the ram frame, so the force from the handle is transferred to the pickup die outer frame 275. The force applied to the handle is sufficient to compress the pickup die springs and force the pickup die outer frame downwardly toward the die table 185'. That action takes up the clearance between the laminate and the shell 63. Further ram advancement causes the ram frame bottom surface 304 and inner surface 307 to progressively bend the laminate 67 over the shell 63. A wrinkled skirt overhangs the shell free edge 69.

At the end of the pickup stroke, the internal groove, if present, in the inner surface 307 of the ram frame 263 is located opposite the shell margin 61. The shell and laminate transfer to the ram 249. The handle 111' is pivoted in the reverse direction 239'. The ram springs 143' urge the ram 249 upwardly against the frame crown 105'. As the ram retracts, the laminate 67 and shell 63 remain inside the ram frame inner surface 307. The draft of the pickup die side surface 274 assists in transferring the shell and laminate from the pickup die 251 to the ram 249.

A flat back 65 is placed on the crimp die pedestal 281. The die table 185' is then indexed in the direction of arrow 241', FIG. 24, until the die table cutout 189' contacts the framework end column 103'. The crimp die 253 is then under the ram 249. See FIG. 20. Indexing the die table to position the crimp die under the ram shifts the ram to the crimp mode. That is achieved by the arcuate travel of the actuator shifter post 191' to contact the finger 269 on the ram frame 263 and rotate the frame to the position shown in FIGS. 20 and 21. In that situation, the holes 164' in the carrier are aligned with the pins 184' in the ram frame.

Figure 20:
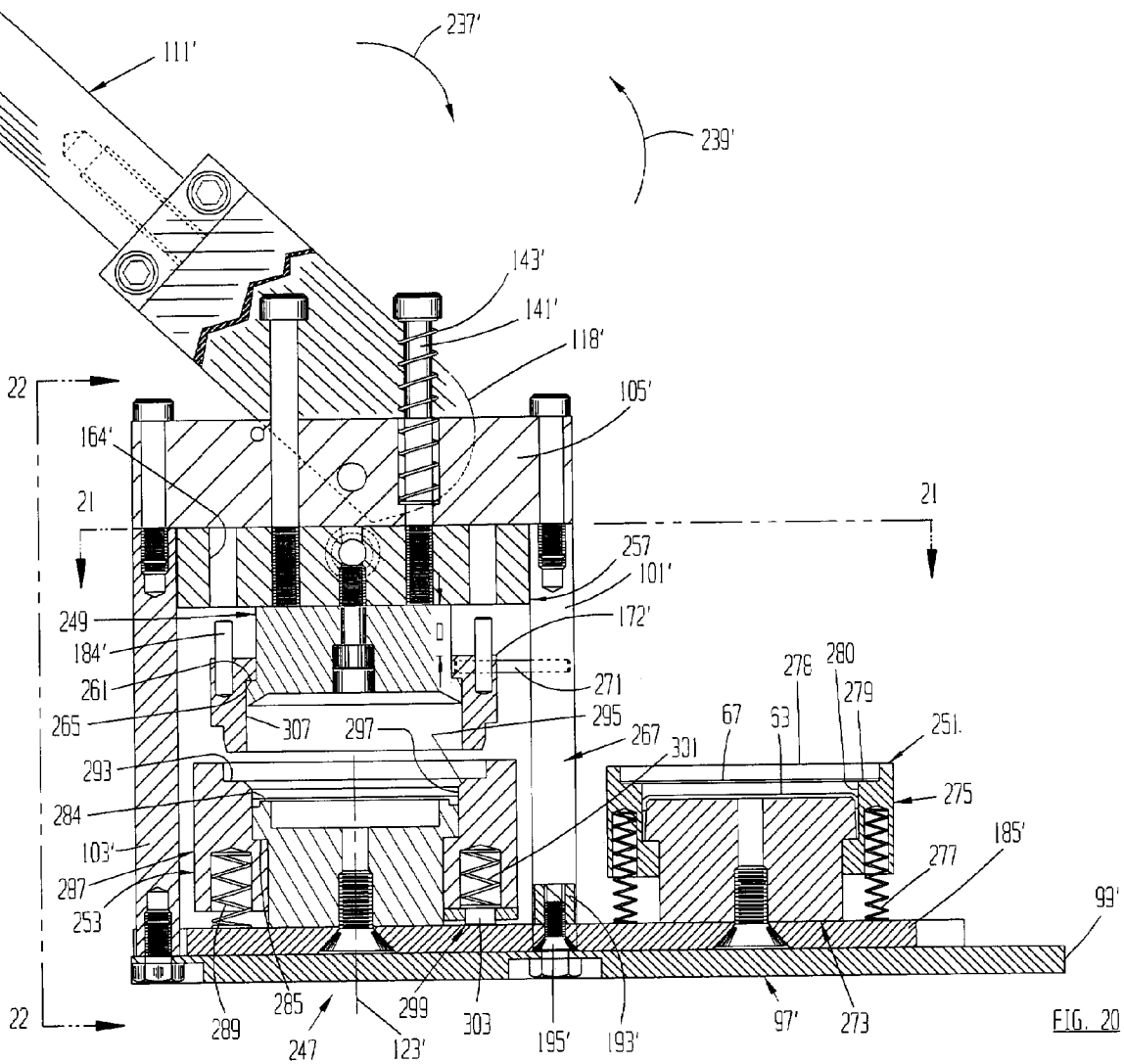
FIG. 20 is a cross-sectional view taken along line 20—20 of FIG. 21 of a machine for manufacturing round buttons with coplanar shell flanges according to the present invention.
Figure 22:
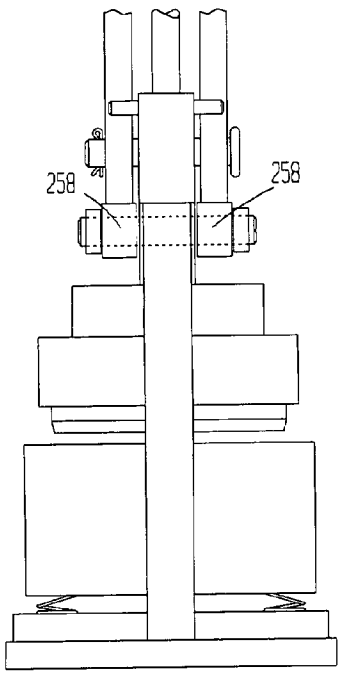
FIG. 22 is a view taken along line 22—22 of FIG. 20.
Figure 21:
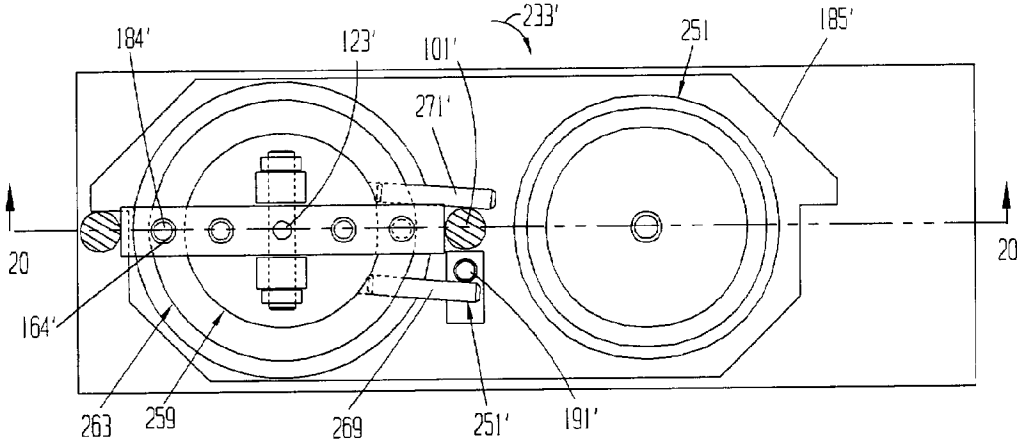
FIG. 21 is a view taken along line 21—21 of FIG. 20.
Figure 25:
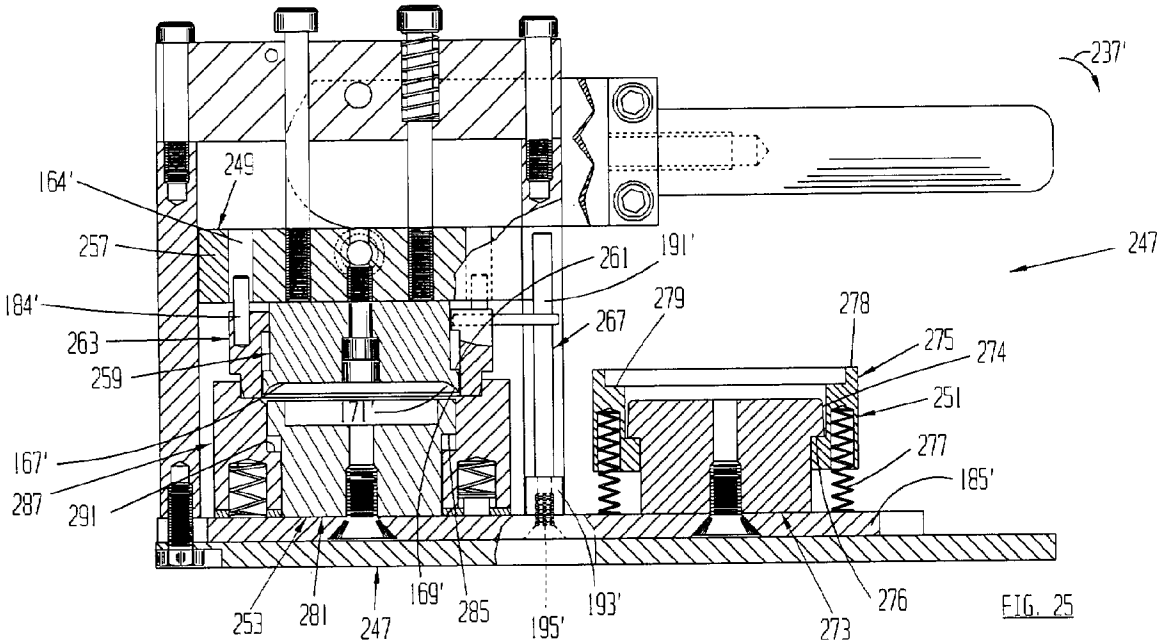
FIG. 25 is a cross-sectional view of the machine of FIGS. 20–24 at the end of the crimp stroke.
Figure 24:
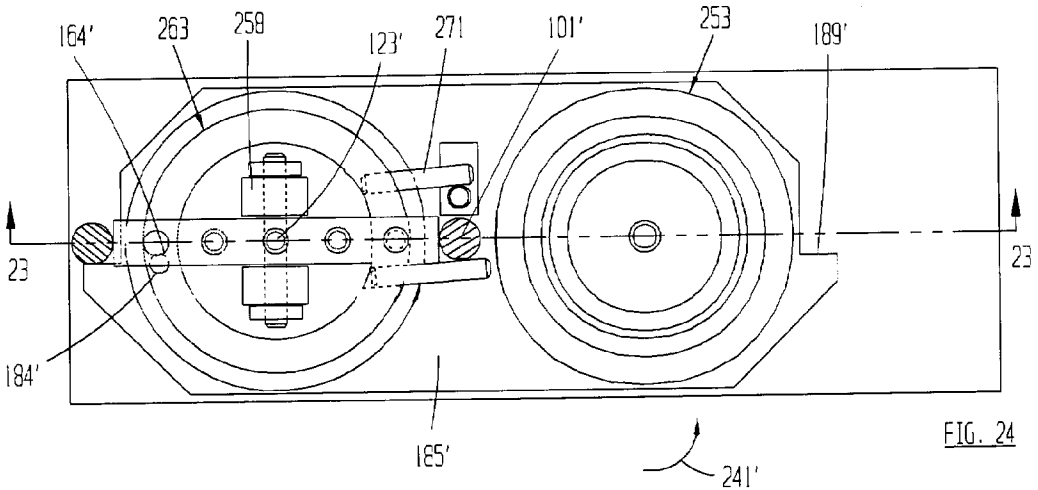
FIG. 24 is a view taken along line 24—24 of FIG. 23.
Figure 23:
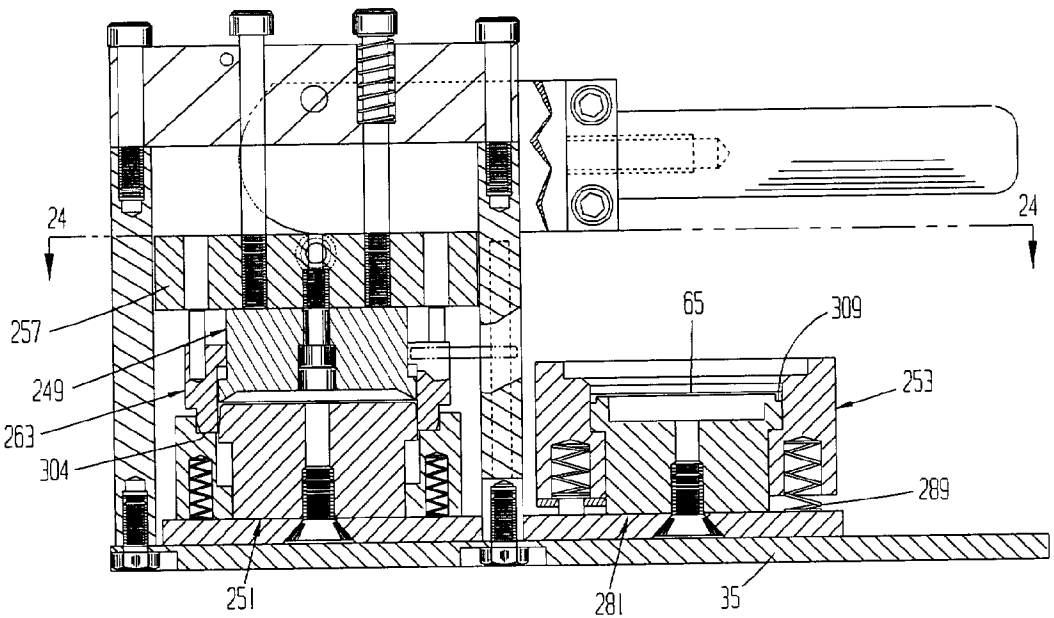
FIG. 23 is a cross-sectional view of the machine of FIGS. 20–22 at the end of the pickup stroke and taken along line 23—23 of FIG. 24.

The operation of the machine 247 during the crimp stroke is substantially identical to the operation of the machine 95 that manufactures the rectangular button 43 as was described previously. The crimp stroke begins as shown in FIG. 20. The handle 111' is pivoted in the direction of arrow 237' to advance the ram 249, together with the laminate 67 and shell 63, along the ram axis 123'. Ram advancement continues in a first movement in which the bottom surface 304 of the ram frame 263 contacts the recess 293 in the crimp die outer frame 287. Also see FIG. 18A.

Although the handle 111' continues to pivot, the springs 289 resist any downward motion of the crimp die outer frame 287 and also any further advancement of the ram frame 263. The pins 184' enter the associated clearance holes 164'. Consequently, the ram plug 259 slides inside the ram frame 263. That action pushes the shell 63 and laminate 67 most of the way out of the ram frame inner surface 307 and also causes the laminate skirt to contact the bevel 295 of the crimp die outer frame 287 and bend inwardly on top of the flat back 65. Advancement of the plug 259 continues in a second movement in which the free edge 69 of the shell approaches the bevel 295 and becomes separated from it only by the laminate. With the plug 259 pushing on the shell, resistance to bending of the metal shell forces the crimp die outer frame downwardly against the resistance of the springs 289. As a result, the shell and laminate approach the flat back 65. The laminate skirt tucks between the shell margin 61 and the flat back periphery 68 in a manner substantially similar to that described previously in connection with FIGS. 18A–18E for the rectangular button 73.

The crimp die outer frame 287 continues to move until the plungers 303 of the spring cells 299 abut the die table 185'. As a result, the shell 63 and laminate 67 further approach the flat back 65. The force of the spring cell springs 301 combine with the force of the crimp die springs 289 to prevent further movement of the crimp die outer frame, so continued pivoting of the handle 111' and advancement of the ram plug 259 is not accompanied by any movement of the crimp die outer frame or the ram frame 263. Consequently, the ram plug slides further inside the ram frame and further pushes the shell and laminate out of the ram frame. Simultaneously, a force is applied to the handle that is sufficient, because of the bevel 295, to bend the shell wall into a frusto-conical shape. The shell frusto-conical wall and the laminate skirt enter a notch between the flat back and a crimp die pedestal relief surface 309. Refer to FIG. 18D.

Figure 5:
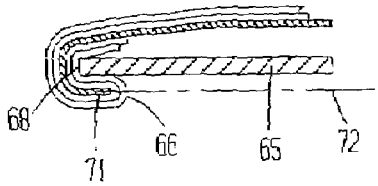
FIG. 5 PRIOR ART
FIG. 5 is a partial cross-sectional view of the assembled button of FIG. 4.
Figure 6:
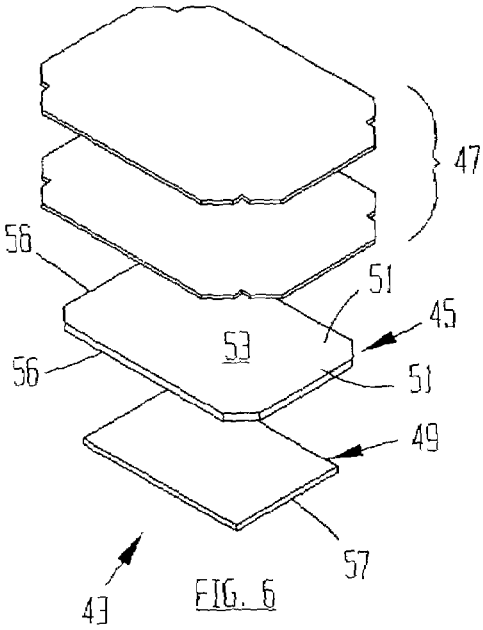
FIG. 6 is an exploded view of the components of a typical prior rectangular button.

To complete the manufacture of the round button 59, a final force is applied to the machine handle 111'. The final force is transferred through the ram carrier 257 to the ram plug 259. The final force advances the ram 249 in a third movement of the crimp stroke in which the ram plug working surface 167' and lip 169' force the shell frusto-conical wall to bend against the crimp die pedestal relief surface 309. As the shell frusto-conical wall is further bent against the crimp die pedestal relief surface, the line of contact between the laminate 67 and the crimp die outer frame bevel 295 moves slightly upwardly along the bevel. That causes the crimp die outer frame 287 to be forced downwardly slightly against the combined forces of the spring cells 299 and the crimp die springs 289 The shell frusto-conical wall thus bends into the flange 71 that is flat and that lies in a single plane 72, FIG. 5. The handle is then reverse pivoted in the direction of arrow 239', the die table 185' is indexed in the direction of arrow 233', and the completed round button 59 is removed from the crimp die 253. In that manner, the round button is completely manufactured using only two strokes of the machine 247.

SUMMARY

In summary, the results and advantages of modern graphics can now be more fully realized. The machines 247 and 95 for manufacturing the round button 59 and rectangular button 73, respectively, provide both efficient two-stroke operation as well as commonality of parts. This desirable result comes from using the combined functions of the spring cells 232 and 299. The spring cells are stiff enough to enable the button shells 75 and 63 to bend in the crimp dies 199 and 253, respectively, but the spring cells yield under final pivoting of the handle 111 or 111' to bend the shells to have respective coplanar flanges 91 and 71. The machine 95 for the rectangular button has a two-part carrier 125 including the shifter cage 131. The actuator shifter post 191 acts on the fingers 165 and 166 to shift the ram 121 between pickup and crimp modes of operation in response to indexing the die table 185. For the round button machine 247, the actuator shifter post 191' acts on the fingers 269 and 271 to rotate the ram frame 263. For both machines, shifting the ram between pickup and crimp modes of operation align and misalign, respectively, pins and clearance holes in the ram. The two-strokes of the ram utilize the misaligned and aligned pins and clearance holes to enable the ram to cooperate with the pickup and crimp dies, respectively, to manufacture the buttons.

It will also be recognized that in addition to the superior performance of the machines 95 and 247, their construction is such as to cost little, if any, more than traditional button machines. In fact, the increased efficiency and productivity inherent in the two-stroke operation quickly pays for any increased cost of the machines.

Thus, it is apparent that there has been provided, in accordance with the invention, a two-stroke machine for making buttons having coplanar shell flanges that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A machine for manufacturing buttons with coplanar shell flanges from a shell, a flexible laminate, and a flat back comprising:

a. a framework;

b. a handle pivotally connected to the framework;

c. a ram that advances and retracts along a ram axis in response to pivoting the handle;

d. a die table indexible on the framework;

e. a pickup die on the die table that initially holds a shell and a flexible laminate, the pickup die being selectively positionable under the ram in response to a first indexing of the die table, the pickup die cooperating with the ram to transfer the shell and flexible laminate from the pickup die to the ram during ram advancement in a first ram stroke;

f. a crimp die on the die table that initially holds a flat back, the crimp die being selectively positionable under the ram in response to a second indexing of the die table, the crimp die comprising:

i. a crimp die pedestal attached to the die table;

ii. a crimp die outer frame slideable on the crimp die pedestal and contacted by the ram during ram advancement in a second ram stroke;

iii. at least one first resilient member interposed between the die table and the crimp die outer frame that produces a first resistance to advancement of the ram during a first movement of the second ram stroke; and iv. at least one second resilient member interposed between the crimp die outer frame and the die table that cooperates with the at least one first resilient member to produce a second resistance to advancement of the ram during a second movement of the second ram stroke; and g. an actuator that shifts the ram between a pickup mode and a crimp mode of operation in response to indexing the die table to position the pickup die and crimp die, respectively, under the ram.

2. The machine of claim 1 wherein:

a. the ram comprises:

i. a carrier;

ii. a plug fastened to the carrier;

iii. a ram frame slideable on the plug; and iv. at least one pin extending from a selected one of the ram frame or the carrier parallel to the ram axis, the other of the selected one of the ram frame and carrier having at least one clearance hole that is selectively alignable and misalignable with said at least one pin; and b. the actuator comprises:

i. first and second fingers on the ram; and ii. a shifter post on the die table that contacts the first finger to shift the ram to the pickup mode of operation whereat said at least one pin is misaligned with said at least one clearance hole in response to indexing the die table to position the pickup die under the ram, the shifter post contacting the second finger to shift the ram to the crimp mode of operation whereat said at least one pin is aligned with said at least one clearance hole in response to indexing the die table to position the crimp die under the ram.

3. The machine of claim 2 wherein:

a. the first and second fingers are in the ram frame; and b. the ram frame rotates on the plug in response to the first and second fingers being contacted by the shifter post to shift the ram to the pickup and crimp modes of operation, respectively.

4. The machine of claim 2 wherein:

a. the carrier comprises a shifter cage;

b. the first and second fingers are on the shifter cage; and c. the shifter cage rotates in response to the first and second fingers being contacted by the shifter post to shift the ram to the pickup and crimp modes of operation, respectively.

5. The machine of claim 2 further comprising at least one support block joined to the ram frame and having an overhang that cooperates with the ram plug to limit the sliding of the ram frame on the plug.

6. The machine of claim 4 wherein:

a. said at least one pin is in the ram frame; and b. said at least one clearance hole is in the shifter cage.

7. The machine of claim 2 wherein:

a. said at least one pin extends from the ram frame;

b. the carrier comprises a shifter cage having said at least one clearance hole therein; and c. the first and second fingers are on the shifter cage, the shifter post contacting the first finger to rotate the shifter cage to misalign said at least one clearance hole therein with said at least one pin in response to indexing the die table to position the pickup die under the ram, and the shifter post contacting the second finger to rotate the shifter cage to align said at least one clearance hole therein with said at least one pin in response to indexing the die table to position the crimp die under the ram.

8. The machine of claim 1 wherein:

a. the ram comprises:

i. a carrier having a guide bar guided in the framework, and a shifter cage having a center cutout;

ii. a plug fastened to the guide bar, the plug supporting the carrier shifter cage for rotation thereon;

iii. a ram frame slideable on the plug;

iv. at least one pin extending from a selected one of the ram frame or the shifter cage parallel to the ram axis, the other of the selected one of the ram frame and shifter cage having at least one clearance hole therein that is selectively alignable and misalignable with said at least one pin; and v. a support block on the ram frame that cooperates with the plug to limit sliding of the ram frame on the plug; and b. the actuator comprises:

i. first and second fingers on the shifter cage; and ii. a shifter post on the die table that is contactable with the first finger to shift the ram to the pickup mode whereat said at least one pin is misaligned with said at least one clearance hole in response to indexing the die table to position the pick up die under the ram, the shifter post being contactable with the second finger to shift the ram to the crimp mode whereat said at least one pin is aligned with said at least one clearance hole in response to indexing the die table to position the crimp die under the ram.

9. The machine of claim 1 wherein the crimp die pedestal and outer frame are configured to manufacture buttons that are round in shape.

10. The machine of claim 1 wherein the crimp die pedestal and outer frame are configured to manufacture buttons that are rectangular in shape.

11. The machine of claim 1 wherein the at least one second resilient member comprises at least one spring cell interposed between the die table and the crimp die outer frame that cooperates with the at least one first resilient member to produce the second resistance to advancement of the ram during the second movement of the ram stroke.

12. The machine of claim 2 wherein the ram frame has an inner surface with a shallow groove that receives the laminate at the end of the first ram stroke and thereby assists in transferring the shell and laminate from the pickup die to the ram.

13. Apparatus for manufacturing buttons comprising:

a. a framework;

b. a handle pivotally connected to the framework;

c. a ram advanceable in first and second ram strokes in response to pivoting the handle in first and second handle strokes, respectively;

d. a die table indexible on the framework;

e. a pickup die on the die table;

f. a crimp die on the die table comprising means for providing a first resistance to advancement of the ram during a first movement of the second ram stroke, and means for providing a second resistance to advancement of the ram during a second movement of the second ram stroke; and g. means for shifting the ram between a pickup mode and a crimp mode of operation in response to indexing the die table to position the pickup die and crimp die, respectively, under the ram.

14. The apparatus of claim 13 wherein:

a. the crimp die comprises a crimp die pedestal attached to the die table, and an outer frame that is contactable by the ram during the first and second movements of the second ram stroke, the crimp die outer frame being slideable over the crimp die pedestal;

b. the means for providing the first resistance comprises multiple first springs between the die table and the crimp die outer frame that bias the crimp die outer frame in the direction opposite the direction of ram advancement during the first and second movements of the second ram stroke; and c. the means for providing the second resistance comprises multiple spring cells in the crimp die outer frame that contact the die table during the second movement of the second ram stroke.

15. The apparatus of claim 13 wherein the means for providing a first resistance comprises means for providing a lesser resistance to the advancement of the ram than the means for providing the second resistance to the advancement of the ram.

16. The apparatus of claim 14 wherein each spring cell comprises a second spring, and a plunger that is out of contact with the die table during the first movement of the second ram stroke and that is in contact with the die table during the second movement of the second ram stroke.

17. The apparatus of claim 14 wherein:

a. the ram comprises:

i. a carrier guided in the framework;

ii. a plug fastened to the carrier;

ii. a ram frame slideable on the plug; and b. the pickup die comprises:

i. a pickup die pedestal, and a pickup die outer frame that is slideable on the pickup die pedestal in response to ram advancement during the first ram stroke; and ii. means for biasing the pickup die outer frame in a direction opposite the direction of ram advancement.

18. The apparatus of claim 17 wherein the ram plug and frame, the pickup die pedestal and outer frame, and the crimp die pedestal and outer frame are configured to manufacture round buttons.

19. The apparatus of claim 17 wherein the ram plug and frame, the pickup die pedestal and outer frame, and the crimp die pedestal and outer frame are configured to manufacture rectangular buttons.

20. The apparatus of claim 18 wherein:

a. the ram further comprises at least one pin in a selected one of the ram frame and carrier;

b. the other of the selected one of the ram frame and carrier defines at least one clearance hole; and c. the means for shifting the ram comprises:

i. first and second fingers on the ram frame; and ii. a shifter post upstanding from the die table, the shifter post contacting the first finger and rotating the ram frame to misalign said at least one pin with said at least one clearance hole in response to indexing the die table to position the pickup die under the ram, the shifter post contacting the second finger and rotating the ram frame to align said at least one pin with said at least one clearance hole in response to indexing the die table to position the crimp die under the ram.

21. The apparatus of claim 19 wherein:

a. the ram further comprises at least one pin in a selected one of the ram frame or the carrier;

b. the other of the selected one of the ram frame and carrier defines at least one clearance hole; and c. the means for shifting the ram comprises:

i. first and second fingers on the carrier; and ii. a shifter post upstanding from the die table, the shifter post contacting the first finger and shifting the carrier to misalign said at least one pin with said at least one clearance hole in response to indexing the die table to position the pickup die under the ram, the shifter post contacting the second finger and rotating the carrier to align said at least one pin with said at least one clearance hole in response to indexing the die table to position the crimp die under the ram.

22. The apparatus of claim 21 wherein:

a. the carrier comprises a guide bar guided in the framework, and a rotatable shifter cage;

b. the first and second fingers are on the shifter cage; and

C. said at least one pin is in a selected one of the shifter cage and ram frame.

23. The apparatus of claim 19 further comprising means for limiting the sliding of the ram frame on the plug.

24. The apparatus of claim 19 further comprising stop blocks joined to the ram frame that cooperate with the plug to limit the sliding of the ram frame on the plug.

25. The apparatus of claim 17 wherein the ram frame has an inner surface that defines a shallow internal groove.

26. In combination with a framework; a ram advanceable in the framework along a ram axis; a die table indexible on the frame; a pickup die attached to the die table; and means for shifting the ram between a pickup mode and a crimp mode of operation in response to indexing the die table, a crimp die comprising:

a. a crimp die pedestal attached to the die table;

b. a crimp die outer frame slideable on the crimp die pedestal in response to being contacted by the ram during advancement thereof;

c. means for producing a first resistance to the sliding of the crimp die outer frame on the crimp die pedestal during a first movement of the ram advancement; and d. means for producing a second resistance to the sliding of the crimp die outer frame on the crimp die pedestal during a second movement of the ram advancement.

27. The combination of claim 26 wherein the means for producing the second resistance is additive to the means for producing the first resistance during the second movement of ram advancement.

28. The combination of claim 26 wherein:

a. the means for producing the first resistance comprises a plurality of first springs interposed between the die table and the crimp die outer frame; and b. the means for producing the second resistance comprises a plurality of spring cells received in the crimp die outer frame, each spring cell comprising a second spring and a plunger.

29. The combination of claim 28 wherein the spring cell plungers contact the die table during the second movement of ram advancement.

30. The combination of claim 29 wherein the first and second springs have respective stiffnesses that combine to resist sliding of the crimp die outer frame on the crimp die pedestal during the second movement of ram advancement.

31. The combination of claim 26 wherein the crimp die pedestal has a round shape that supports a round flat back and that cooperates with the ram and crimp die outer frame to assemble the flat back to a round shell and a round flexible laminate in response to advancement of the ram.

32. The combination of claim 26 wherein the crimp die pedestal has a rectangular shape that supports a rectangular flat back and that cooperates with the ram and crimp die outer frame to assemble the flat back to a rectangular shell and a rectangular flexible laminate in response to advancement of the ram.

33. The combination of claim 26 wherein the crimp die pedestal has a top surface that supports a flat back, and a relief surface proximate the top surface, the crimp die pedestal top surface and relief surface cooperating with the ram and the crimp die outer frame to assemble the flat back to a shell and a flexible laminate to manufacture a button having coplanar shell flanges.

34. The combination of claim 26 wherein:

a. the crimp die outer frame has a top surface with a recess therein, and a bevel that intersects the recess;

b. the means for producing a second resistance comprises a plurality of spring cells received in the crimp die outer frame, each spring cell comprising a second spring and a plunger c. the crimp die pedestal has a top surface, and a relief surface proximate the top surface; and d. the crimp die outer frame bevel and the crimp die pedestal relief surface cooperate to form a substantially continuous surface when the spring cells plungers contact the die table.

* * * * *